US007407560B2

(12) United States Patent
Hilbig et al.

(10) Patent No.: US 7,407,560 B2
(45) Date of Patent: Aug. 5, 2008

(54) LOTIONED AND EMBOSSED TISSUE PAPER

(75) Inventors: Klaus Hilbig, Frankfurt (DE); Marcel Karel Nelis Liplijn, Frankfurt am Main (DE); Birgit Zint-Schuessler, Sulzbach (DE)

(73) Assignee: The Procter & Gamble Company, Cincinnati, OH (US)

( * ) Notice: Subject to any disclaimer, the term of this patent is extended or adjusted under 35 U.S.C. 154(b) by 443 days.

(21) Appl. No.: 10/619,656

(22) Filed: Jul. 15, 2003

(65) Prior Publication Data

US 2004/0055721 A1 Mar. 25, 2004

Related U.S. Application Data

(63) Continuation-in-part of application No. PCT/US02/05364, filed on Feb. 13, 2002.

(30) Foreign Application Priority Data

Feb. 16, 2001 (EP) ..... 01103786

(51) Int. Cl.
*B31F 1/07* (2006.01)
*D21H 27/40* (2006.01)
*D21H 23/22* (2006.01)

(52) U.S. Cl. ..... 162/123; 162/117; 162/135; 162/184; 162/194; 162/205; 424/402; 428/172; 428/156; 156/209

(58) Field of Classification Search ..... 162/109, 162/116–117, 123–135, 196–197, 204–207, 162/183–184, 194; 156/209, 219; 428/156, 428/537.5, 172; 424/402
See application file for complete search history.

(56) References Cited

U.S. PATENT DOCUMENTS

| | | | | | |
|---|---|---|---|---|---|
| 3,077,390 | A * | 2/1963 | List et al. | 48/54 |
| 3,285,800 | A * | 11/1966 | Bartell et al. | 428/159 |
| 3,414,459 | A * | 12/1968 | Wells | 428/180 |
| 3,953,638 | A * | 4/1976 | Kemp | 428/154 |
| 4,481,243 | A | 11/1984 | Allen | |
| 5,269,983 | A * | 12/1993 | Schulz | 264/400 |
| 5,409,572 | A * | 4/1995 | Kershaw et al. | 162/109 |
| 5,525,345 | A | 6/1996 | Warner et al. | |
| 5,693,403 | A | 12/1997 | Brown et al. | |
| 5,702,571 | A | 12/1997 | Kamps et al. | |
| 5,904,812 | A | 5/1999 | Salman et al. | |
| 5,990,377 | A * | 11/1999 | Chen et al. | 604/381 |
| 6,030,690 | A * | 2/2000 | McNeil et al. | 428/156 |
| 6,033,523 | A * | 3/2000 | Dwiggins et al. | 162/111 |
| 6,086,715 | A * | 7/2000 | McNeil | 162/132 |
| 6,187,137 | B1 * | 2/2001 | Druecke et al. | 162/109 |
| 6,197,154 | B1 * | 3/2001 | Chen et al. | 162/109 |
| 6,207,014 | B1 * | 3/2001 | de Haut et al. | 162/164.7 |
| 6,277,467 | B1 * | 8/2001 | Dwiggins et al. | 428/156 |
| 6,287,676 | B1 * | 9/2001 | Ruppel et al. | 428/219 |
| 6,348,131 | B1 * | 2/2002 | Kershaw et al. | 162/112 |
| 6,352,700 | B1 * | 3/2002 | Luu et al. | 424/402 |
| 6,355,139 | B1 * | 3/2002 | Baggot et al. | 162/109 |
| 6,395,957 | B1 * | 5/2002 | Chen et al. | 604/381 |
| 6,423,397 | B1 * | 7/2002 | Roussel | 162/109 |
| 6,440,268 | B1 * | 8/2002 | Baggot et al. | 162/118 |
| 6,455,129 | B1 * | 9/2002 | Kershaw et al. | 428/156 |
| 6,468,392 | B2 * | 10/2002 | Oriarian et al. | 162/109 |
| 6,475,501 | B1 * | 11/2002 | Kelly et al. | 424/404 |
| 6,517,849 | B1 * | 2/2003 | Seger et al. | 424/402 |
| 6,544,386 | B1 * | 4/2003 | Krzysik et al. | 162/123 |
| 6,599,614 | B1 * | 7/2003 | Roussel et al. | 428/172 |
| 6,602,387 | B1 * | 8/2003 | Loughran et al. | 162/117 |
| 6,602,577 | B1 * | 8/2003 | Ostendorf et al. | 428/156 |
| 6,610,173 | B1 * | 8/2003 | Lindsay et al. | 162/109 |
| 6,656,569 | B1 * | 12/2003 | Roussel et al. | 428/154 |
| 6,733,866 | B2 * | 5/2004 | Muller | 428/172 |
| 6,802,937 | B2 * | 10/2004 | Johnston et al. | 162/117 |
| 6,805,766 | B1 * | 10/2004 | Roussel et al. | 156/209 |
| 6,863,107 | B2 * | 3/2005 | Hein et al. | 156/470 |
| 6,916,403 | B2 * | 7/2005 | Basler et al. | 156/209 |
| 2001/0008179 | A1 * | 7/2001 | Oriarian et al. | 162/109 |
| 2001/0042606 | A1 * | 11/2001 | Harper et al. | 162/111 |
| 2003/0026953 | A1 * | 2/2003 | Muller | 428/174 |
| 2003/0075262 | A1 * | 4/2003 | Hein et al. | 156/209 |
| 2003/0228444 | A1 * | 12/2003 | Johnston et al. | 428/156 |
| 2004/0055694 | A1 * | 3/2004 | Kershaw et al. | 156/209 |
| 2005/0230069 | A1 * | 10/2005 | Hilbig et al. | 162/117 |
| 2006/0008621 | A1 * | 1/2006 | Gusky et al. | 428/156 |

FOREIGN PATENT DOCUMENTS

| | | | |
|---|---|---|---|
| EP | 0 499 942 | B1 | 8/1997 |
| EP | 0 668 152 | B1 | 12/1998 |
| EP | 0 957 201 | A1 | 11/1999 |
| EP | 1232854 | A1 * | 8/2002 |
| EP | 1233107 | A1 * | 8/2002 |
| EP | 1361308 | A1 * | 11/2003 |
| EP | 1365068 | A1 * | 11/2003 |
| EP | 1878830 | A1 * | 1/2008 |
| GB | 2376436 | A * | 12/2002 |
| WO | WO 9527429 | A1 * | 10/1995 |
| WO | WO 96/19204 | | 6/1996 |
| WO | WO 9858124 | A1 * | 12/1998 |
| WO | WO 9906634 | A1 * | 2/1999 |
| WO | WO 9945205 | A1 * | 9/1999 |
| WO | WO 00/73585 | | 12/2000 |
| WO | WO 03104552 | A2 * | 12/2003 |

* cited by examiner

*Primary Examiner*—José A Fortuna
(74) *Attorney, Agent, or Firm*—Peter T. Nguyen; David M. Weirich; Peter D. Meyer

(57) ABSTRACT

A paper tissue such as a facial tissue or a disposable handkerchief and a method of making the tissue. The method includes passing the tissue paper web through an embossing nip formed between a first and a second embossing roll, wherein at least one of the embossing rolls comprises at least 30 embossing elements per square centimeter and applying a transferable lotion to at least portions of the tissue paper web.

7 Claims, No Drawings

LOTIONED AND EMBOSSED TISSUE PAPER

CROSS-REFERENCE TO RELATED APPLICATIONS

This application is a continuation-in-part of International Application PCT/US02/05364, with an international filing date of Feb. 13, 2002.

FIELD OF THE INVENTION

The present invention relates to paper tissue products, and in particular to facial tissue, and disposable handkerchiefs. More particularly, the invention relates to a lotioned paper tissue product comprising a paper tissue substrate of improved quality.

BACKGROUND OF THE INVENTION

Paper webs or sheets, sometimes called tissue or paper tissue webs or sheets, and products made therefrom, such as paper handkerchiefs, sometimes also called facial tissues, find extensive use in modern society. Such items as facial and toilet tissues and kitchen towels are staple items of commerce, all of which are herein referred to as paper tissue products. It has long been recognized that important physical attributes of these products are their strength and thickness/caliper, their softness and smoothness, their absorbency, and their lint resistance. Research and development efforts have been directed to the improvement of each of these attributes without seriously affecting the others as well as to the improvement of two or three attributes simultaneously.

Softness and smoothness relate to the tactile sensation perceived by the consumer when holding a particular product, rubbing it across the skin, or crumpling it within the hands. The tactile sensation is a combination of several physical properties. The tactile sensation can be well captured by the objective parameter of the physiological surface smoothness (PSS) parameter as known e.g. from U.S. Pat. No. 5,855,738. As important for the tactile sensation of consumers is the thickness/caliper of a tissue product.

Strength is the ability of the product to maintain physical integrity and to resist tearing, bursting, and shredding under use conditions.

Absorbency is the measure of the ability of a product to absorb quantities of liquid, particularly aqueous solutions or dispersions. Overall absorbency as perceived by the consumer is generally considered to be a combination of the total quantity of a liquid a given mass of paper tissue will absorb at saturation as well as the rate at which the mass absorbs the liquid.

Lint resistance is the ability of the fibrous product, and its constituent webs, to bind together under use conditions, including when wet. In other words, the higher the lint resistance is, the lower the propensity of the web to lint will be.

Through-air-drying can provide high wet burst strength as well as relatively high caliper. Though-air-drying facilities, however, are not generally available on conventional paper making machines and the provision of such equipment means a considerable financial investment. Further, though-air-drying facilities typically have an increased energy consumption as compared to more conventional drying facilities. Therefore it is still of interest to provide superior paper qualities employing conventional paper machines.

It is known in the art to provide facial tissue and paper handkerchiefs with additives to achieve skin care or pharmaceutical benefits, e.g. in the from of lotions. However, the present invention attempts to alleviate the detrimental effects of highly transferable lotions by providing a paper quality and structure particularly suitable for lotioned tissue paper, which still can be produced in a very economic fashion. In particular, the present invention can provide any or all of the following:

- improved strength, especially wet burst strength, absorbency and lint resistance.
- improved tactile sensation of softness, smoothness and thickness.
- a cost effective way to manufacture improved tissue on conventional paper machines and/or through-air-dried paper machines.
- a process that allows for the economic application of a lotion.
- a product that avoids unwanted premature lotion transfer while ensuring good lotion transfer to a user when needed.

SUMMARY OF THE INVENTION

The present invention relates to a paper tissue, and in particular to facial tissue, and disposable handkerchiefs. Claimed and described is a method for making a tissue paper product from a tissue paper web, the method comprising the steps of:

- passing said tissue paper web through an embossing nip formed between a first and a second embossing roll, wherein at least one of said embossing rolls comprises at least 30 embossing elements per square centimeter.
- applying a transferable lotion to at least portions of said tissue paper web Further claimed are paper tissue products made in accordance with the above method.

DETAILED DESCRIPTION OF THE INVENTION

Suitable Papermaking Steps

According to the present invention, a cellulosic fibrous structure is made using principles and machinery well-known in the art of paper-making. A suitable pulp furnish for the process of making the paper tissue substrate preferably contains papermaking fibers consisting essentially of cellulose fibers (commonly-known as wood pulp fibers) or cellulose-derived fibers (including, for example, rayon, viscose). Fibers derived from soft woods (gymnosperms or coniferous trees) and hard woods (angiosperms or deciduous trees) are contemplated for use in this invention. The particular species of tree from which the fibers are derived is immaterial. The wood pulp fibers can be produced from the native wood by any convenient pulping process. Chemical processes such as sulfite, sulphate (including the Kraft) and soda processes are suitable. Mechanical processes such as thermochemical (or Asplund) processes are also suitable. In addition, the various semi-chemical and chemi-mechanical processes can be used. Bleached as well as unbleached fibers are contemplated for use.

In addition to the above method of making the tissue, other methods may be employed and fibers and/or filaments made from polymers, for example hydroxyl polymers, may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

The paper tissue according to the present invention may contain a wet strength chemical agent. Generally, the wet strength agent is added up to about 3.0%, at least about 0.5%, or at least about 0.8% by weight, on a dry fiber weight basis, of wet strength chemical agent, such as water-soluble permanent and temporary wet strength resin. Wet strength resins useful herein can be of any suitable type. For example, Westfelt described a number of such materials and discussed their chemistry in Cellulose Chemistry and Technology, Volume 13, at pages 813-825 (1979).

Usually, the wet strength resins are water-soluble, cationic materials. That is to say, the resins are water-soluble at the time they are added to the papermaking furnish. It is quite possible, that subsequent events such as cross-linking will render the resins insoluble in water. Further some resins are soluble only under specific conditions, such as over a limited pH range. Wet strength resins are generally believed to undergo a cross-linking or other curing reactions after they have been deposited on, within, or among the papermaking fibers. Cross-linking or curing does not normally occur so long as substantial amounts of water are present.

Of particular utility are the various polyamide-epichlorohydrin resins. These materials are low molecular weight polymers provided with reactive functional groups such as amino, epoxy, and azetidinium groups. Descriptions of processes for making such materials include U.S. Pat. No. 3,700,623, issued to Keim on Oct. 24, 1972, and U.S. Pat. No. 3,772,076, issued to Keim on Nov. 13, 1973.

Polyamide-epichlorohydrin resins sold under the trademarks Kymene 557H and Kymene LX by Hercules Inc. of Wilmington, Del., are particularly useful in this invention. These resins are generally described in the aforementioned patents to Keim.

Base-activated polyamide-epichlorohydrin resins useful in the present invention are sold under the Santo Res trademark, such as Santo Re 31, by Monsanto Company of St. Louis, Mo. These types of materials are generally described in U.S. Pat. No. 3,855,158 issued to Petrovich on Dec. 17, 1974; U.S. Pat. No. 3,899,388 issued to Petrovich on Aug. 12, 1975; U.S. Pat. No. 4,129,528 issued to Petrovich on Dec. 12, 1978; U.S. Pat. No. 4,147,586 issued to Petrovich on Apr. 3, 1979; and U.S. Pat. No. 4,222,921 issued to Van Eenam on Sep. 16, 1980.

Other water-soluble cationic resins useful herein are the polyacrylamide resins such as those sold under the Parez trademark, such as Parez 631NC, by American Cyanamid Company of Sandford, Conn. These materials are generally described in U.S. Pat. No. 3,556,932 issued to Coscia et al. on Jan. 19, 1971; and U.S. Pat. No. 3,556,933 issued to Williams et al. on Jan. 19, 1971.

Yet, other types of water-soluble resins useful in the present invention include acrylic emulsions and anionic styrene-butadiene latexes. Numerous examples of these types of resins are provided in U.S. Pat. No. 3,844,880 issued to Meisel, Jr. et al. on Oct. 29, 1974. Still other water-soluble cationic resins finding utility in this invention are the urea formaldehyde and melamine formaldehyde resins. These polyfunctional, reactive polymers have molecular weights on the order of a few thousand. The more common functional groups include nitrogen containing groups such as amino groups and methylol groups attached to the nitrogen. Although less preferred, polyethylenimine type resins find utility in the present invention.

More complete descriptions of the aforementioned water-soluble resins, including their manufacture, can be found in TAPPI Monograph Series No. 29, "Wet Strength in paper and Paperboard, Technical Association of the Pulp and Paper Industry (New York; 1965).

Temporary wet strength agents, such as modified starch may also, optionally, be used. Combinations of permanent and temporary wet strength agents may be used.

The present invention may contain dry strength chemical agents, preferably at levels up to 3% by weight, or at least 0.1% by weight, on a dry fiber weight basis. An exemplary dry strength chemical agent is carboxymethyl cellulose. Other suitable dry strength chemical agents include polyacrylamide (such as combinations of Cypro™ 514 and Accostrength™ 711 produced by American Cyanamid of Wayne, N.J.); starch (such as corn starch or potato starch); polyvinyl alcohol (such as Airvol™ 540 produced by Air Products Inc. of Allentown, Pa.); guar or locust bean gums; and polyacrylate latexes. Suitable starch materials may also include modified cationic starches such as those modified to have nitrogen containing groups such as amino groups and methylol groups attached to nitrogen, available from National Starch and Chemical Company (Bridgewater, N.J.).

Chemical softening compositions, comprising chemical debonding agents are optional components of the present invention. U.S. Pat. No. 3,821,068, issued Jun. 28, 1974 teaches that chemical debonding agents can be used to reduce the stiffness, and thus enhance the softness, of a paper tissue web. U.S. Pat. No. 3,554,862, issued on Jan. 12, 1971 discloses suitable chemical debonding agents. These chemical debonding agents include quaternary ammonium salts.

Exemplary suitable chemical softening compositions comprise from about 0.01% to about 3.0% of a quaternary ammonium compound, preferably a biodegradable quaternary ammonium compound; and from about 0.01% to about 3.0% of a polyhydroxy compound; preferably selected from the group consisting of glycerol, sorbitols, polyglycerols having an average molecular weight of from about 150 to about 800 and polyoxyethylene glycols and polyoxypropylene glycols having a weight average molecular weight from about 200 to 4000. Preferably the weight ratio of the quaternary ammonium compound to the polyhydroxy compound ranges from about 1.0:0.1 to 0.1:1.0. It has been discovered that the chemical softening composition is more effective when the polyhydroxy compound and the quaternary ammonium compound are first premixed together, preferably at a temperature of at least 40° C., before being added to the papermaking furnish. Either additionally, or alternatively, chemical softening compositions may be applied to the substantially dry paper tissue web, for example by means of a printing process (N.B. all percentages herein are by weight of dry fibers, unless otherwise specified).

Examples of quaternary ammonium compounds suitable for use in the present invention include either unmodified, or mono- or di-ester variations of well-known dialkyldimethylammonium salts and alkyltrimethyl ammonium salts. Examples include the di-ester variations of di(hydrogenated tallow)dimethyl ammonium methylsulphate and di-ester variations of di(hydrogenated tallow)dimethyl ammonium chloride. Without wishing to be bound by theory, it is believed that the ester moity(ies) lends biodegradability to these compounds. Commercially available materials are available from Witco Chemical Company Inc. of Dublin, Ohio, under the tradename "Rewoquat V3512". Details of analytical and testing procedures are given in WO95/11343, published on 27 Apr. 1995.

Examples of polyhydroxy compounds useful in the present invention include polyoxyethylene glycols having a weight average molecular weight of from about 200 to about 600, especially preferred is "PEG-400".

While the addition of particular chemical agents listed above can have very beneficial effects on the paper products obtained, namely their softness, paper tissue webs useful for the present invention may be made by any common method well-known to the person skilled in the art.

Typical papermaking processes comprise the dewatering of suitable pulp using, for example, one or more papermakers felts and/or belts. Any process referred to herein as conventional is a paper-making process which does not comprise a step of through-air-drying. However, papermaking processes comprising a through-air-drying step can be utilized.

Stretch Embossing Step

The present invention is specifically concerned with steps known in the art as converting steps. One important converting step to be carried out in accordance with the present invention is an embossing step in which a very fine pattern is embossed using a low pressure. Embossing of a paper tissue web is generally achieved by passing the web through the nip formed between two embossing rolls, at least one embossing roll comprising embossing elements. An embossing roll typically comprises a curved, but otherwise flat surface. Embossing elements are protrusions raising above this surface and having a certain height as measured in a direction perpendicular to the axis of the embossing roll from the curved flat roll surface to the utmost point of the protrusion. Embossing elements have a certain width, to be measured in the plane of the essentially flat roll surface. The term width as used herein refers to the diameter of a round embossing element measured the plane specified above (i.e. at the bottom of the embossing element) or to the largest width measured in said plane, when the embossing element is not round.

According to the present invention the embossing elements can have any shape, such as pyramidal or half spherical, and the cross section of the embossing elements can be circular, oval or square. The embossing elements may form a continuous pattern, but preferably are distinct form each other. The embossing elements may be disposed over at least one embossing roll in a very fine pattern, comprising at least 30 embossing elements, preferably at least 50, more preferably at least 60, yet more preferably at least 70, most preferably at least 80 embossing elements per square centimeter surface area of the embossing roll.

According to the present invention the embossing elements preferably have a height of less than 1 mm, more preferably less than 0.8 mm, yet more preferably less than 0.6 mm, yet even more preferably less than 0.5 mm or less than 0.4 mm, and most preferably less than 0.3 mm. Preferably the stretch embossing provides a ratio of embossed areas to unembossed areas is from about 5% to about 95%, more preferably about 20% to about 80% and most preferably about 40% to about 60%.

Any known type of embossing roll and mode of operation of such roll is within the scope of the present invention. In one embodiment of the present invention two hard metal, e.g. steel, embossing rolls are used, wherein a first roll comprises protruding embossing elements, referred to as the male roll, and a second roll comprises matching recesses, referred to a the female roll. The recesses may be mirror images of the protruding embossing elements or may be adapted to be slightly smaller than exact mirror images, e.g. due to a slight difference in size or shape (e.g. slope) of those recesses in the female roll.

In another embossing step according to the present invention a first embossing roll comprises a web contacting surface provided from a hard material comprising protruding embossing elements and a second roll comprises a web contacting surface comprising a softer material, e.g. rubber, preferably a material of Shore A hardness of about 40 to about 70, in which recesses are formed upon sufficiently close contact with the protruding embossing elements.

The size of the nip formed between the two embossing rolls is to be adapted depending e.g. on the tissue paper web to be processed and depending on the embossing pattern used. Also depending on those considerations no pressure or some pressure may be applied to urge the first embossing roll and the second embossing roll together.

When two hard rolls are employed in the process, a male and a female role, the rolls should be operated so as to leave a space corresponding to about 60% to about 140%, preferably about 80% to about 120% of the caliper of the unembossed tissue paper between the protruding embossing elements of the male role and the bottom of the recesses of the female role.

When a hard roll is used in combination with a rubber roll, the rolls should be pressed against each other with a pressure of about 10 N/square centimeter to about 1000 N/square centimeter, preferably about 20 N/square centimeter to about 200 N/square centimeter and most preferably about 50 N/square centimeter to about 100 N/square centimeter.

Known modes of operation are suitable for the present invention, preferably the embossing rolls are not heated and run at the same speed, but in alternative modes of operation at least one roll may be heated and the rolls may run at unequal speed.

The above described embossing with a fine pattern can serve to increase the caliper, or in other words the bulk of the paper tissue web. Therefore, in one embodiment of the present invention a single web or a single ply of paper tissue is passed through the embossing nip. In alternative modes of operation a multitude of plies of paper may be passed through the nip at the same time. Further, it is also contemplated to employ a separate and distinct joining step as to provide a multiply tissue paper product.

Lotion Application

According to the present invention before or after the stretch embossing, but typically after the stretch embossing, a lotion is applied to the tissue paper. The lotion may be applied by any suitable means, such as printing or spraying. The lotion can either be applied to the paper web or a paper tissue product, either to the whole surface of the web or product or only to a portion thereof. For a multiple ply paper tissue product the lotion may be applied to all plies or only selected plies and to only one or to both surfaces of the plies. In one preferred embodiment lotion is applied to both outer surfaces of the paper tissue product.

A lotion has been found to contribute to the smoothness of the paper tissue, and hence decrease its PSS parameter. Moreover, the lotion can provide skin care benefits.

The lotion may comprise softening/debonding agents, emollients, immobilizing agents and mixtures thereof. Suitable softening/debonding agents include quaternary ammonium compounds, polysiloxanes, and mixtures thereof. Suitable emollients include propylene glycol, glycerine, triethylene glycol, spermaceti or other waxes, petrolatum, fatty acids, fatty alcohols and fatty alcohol ethers having from 12 to 28 carbon atoms in their fatty acid chain, mineral oil, namely silicone oil e.g. dimethicone and isopropyl palmitate, and mixtures thereof. Suitable immobilizing agents include ceresin, stearyl alcohol and paraffins, polyhydroxy fatty acid esters, polyhydroxy fatty acid amides, and mixtures thereof.

Other optional components include perfumes, antibacterial actives, antiviral actives, disinfectants, pharmaceutical actives, film formers, deodorants, opacifiers, astringents, solvents and the like. Particular examples of lotion components include camphor, thymol, menthol, camomile extract, aloe vera, *calendula officinalis*.

Transferable lotions are typically preferred as transferability ensures superior skin care and pharmaceutical benefits. The term "transferable lotion", as used herein, refers to any lotion, which achieves a transfer rate of more than 0.25% according to the stationary lotion transfer test on unembossed paper described herein. Preferred transferable lotions achieve a transfer rate of more than 0.5%, more preferably more than 1%, 2% or 5% according to the stationary lotion transfer test on unembossed paper described herein. The level of transferability can be relatively high to optimally achieve the benefits associated with the lotion, as most of the disadvantages hitherto associated with the use of high amounts of a highly transferable lotion are overcome by the present invention.

Data on stretch embossed and unembossed tissue paper have been obtained under stationary and under dynamic conditions using the test method described hereinafter:

| | Unembossed product | Same product stretch embossed before lotion application |
|---|---|---|
| Stationary Transfer | 5.14% | 2.25% |
| Dynamic Transfer | 21.83% | 21.12% |

The data obtained by the lotion transfer test described hereinafter confirm some of the beneficial effects of products made in accordance with the present invention. The product, which was stretch embossed in accordance with the present invention, delivers a very low amount of lotion when is stationary contact with a surface, but delivers a much higher amount of lotion when rubbed over a surface.

Stationary contact with a surface is representative of the contact of a tissue paper product with the packaging material when the product is packaged. A low lotion transfer rate avoids the need for expensive packaging material. Stationary contact with a surface is further representative of the contact of a tissue paper product with the finger tips of a user when taking such a tissue paper product out of the package and preparing to use it e.g. in the nasal area. While the beneficial effects of a lotion will typically be desired in the nasal area, transfer of the lotion to the fingertips of a user is typically undesired and experienced as an unwanted feeling of greasiness, which may even trigger a need to wash one's hands.

Rubbing over a surface is representative of the usage of a lotioned tissue paper product in the target area, which most often is the nasal area. A slight rubbing movement in the nasal area is a frequently encountered usage habit, which of course can be enhanced by providing users with appropriate usage instructions.

As compared with an unembossed product the product which was stretch embossed in accordance with the present invention, delivers considerably less lotion when in stationary contact with a surface than the stretch embossed product. However, the lotion delivery upon a rubbing action is no worse than for an unembossed tissue paper product.

Preferred tissue paper products according the present invention will achieve a lotion transfer upon rubbing which is at least about 1.1 times, preferably about 1.5 times, more preferably about 2 times, about 5 times, about 7 times or at least about 8 times as high as the stationary lotion transfer measured in accordance with the test procedures described hereinafter.

Optional Process Steps

The method for making a tissue paper product according to the present invention may comprise a number of further optional steps. Any known method of calendering can be employed in the converting process. Preferably, the calendering step is carried out after the stretch embossing and before the lotion application.

A calendering step in accordance with the present invention may include passing one or several tissue paper webs through a calendering nip formed between a first and a second calendering roll. Typically both calendering rolls contact the web over a certain length, herein referred to a contact length, measured parallel to the direction of the axis of said first calendering roll. The calendering rolls exert a pressure onto the web of at least 30 N per centimeter of said contact length and in order to do so will be pressed against each other with such a pressure. More preferably the pressure per centimeter of said contact length is from 50 N to 300 N, more preferably 60 N to 250 N, yet more preferably 70 N to 200 N and most preferably 120 N to 150 N. According to the present invention, as many paper tissue webs are calendered as the paper tissue product will comprise plies, for example two, three or four webs can be juxtaposed and calendered in one step.

Known equipment and known modes of operation are suitable for the present invention. Further, at least one roll may be heated and the rolls may run at unequal speed.

Calendering is well known in the art to reduce the caliper of a tissue paper web, and typically employed to ensure the caliper of the paper tissue product meets the required specifications. Due to the pressure employed, leading to a densification of the paper web, calendering is known to reduce the perceived softness of a paper tissue product. Calendering is therefore, at least in the area of hygiene papers, such a paper handkerchiefs, carried out at not too high pressures, typically for an embossed paper web 10 N/cm to 20 N/cm are selected.

It has been surprisingly found that the embossing step described in combination with the calendering step leads to a rather thick and bulky and yet still very soft paper product. More particularly, it has been found that the paper tissue web after undergoing a stretch embossing step and a calendering step is of increased caliper as compared to the untreated web. (When e.g. three webs are calendered in one step the comparison is to be made between three layers of untreated web versus three layers of embossed and calendered web.) This effect is particularly surprising, as calendering with a high pressure is known to reduce the caliper of a paper web considerably, as for example stated in German patent application DE 0 44 14 238.2.

The method claimed in the present invention has been found to increase the caliper of a paper tissue web by about 10%, sometimes even 30% and even up to about 40%, about 60%, about 80% or about 100% when comparing the caliper of the untreated web with the caliper of the treated web. The stretch embossing step alone can achieve caliper increases of about 50% to about 200%.

A paper tissue according to the present invention has a first and a second surface, the surfaces being mutually opposed to each other, and a thickness orthogonal to the first and second surface. The thickness is also referred to a caliper of the tissue. The caliper of a 3-ply paper tissue product according to the present invention is preferably from about 0.1 mm to about 1 mm, more preferably from about 0.2 mm to about 0.5 mm.

Moreover, a paper tissue according to the present invention has preferably a wet burst strength greater than about 50 g, more preferably greater than about 100 g, preferably from about 150 g to about 500 g, more preferably from about 250 g to about 400 g.

It has been found that the method claimed herein leads to a considerable reduction of the dry tensile strength of the paper tissue without seriously affecting the wet burst strength of the paper tissue. Paper tissues treated with the claimed method typically achieve a dry tensile strength from about 1000 g to about 2500 g and a wet burst strength of about 100 g to about 300 g and preferably achieve a dry tensile strength to wet burst strength ratio of about 0.1 to about 0.3, preferably about 0.125 to about 0.25 and most preferably about 0.15 to about 0.2.

In a further aspect, a paper tissue product according to the present invention preferably has a physiological surface smoothness parameter of less than about 1000 microns, preferably from about 650 microns to about 50 microns, more preferably from about 650 microns to about 300 microns.

In one preferred embodiment of the present invention a paper tissue product is provided from two plies to four plies, three plies being most preferred. Preferably all plies comprise a stretch embossing pattern extending over at least about 50%, but preferably about 80% of the whole surface area of the paper tissue product and most preferably the whole surface area of the paper tissue product.

Juxtaposed plies of the paper tissue web may be joined as to provide a multi ply paper tissue product, preferably by attachment embossing. "Attachment embossing", as used herein, refers to an embossing by which all plies of a multi-ply tissue according to the present invention are embossed in one process step. Preferably the attachment embossing does not or at least not to a large extent affect the smoothness of any calendered ply. Therefore, the tissue has an unembossed surface over a major part of the surface area of the tissue, preferably on the first and the second surface. As used herein, this means that the tissue has one or more regions not comprising an attachment embossing and, optionally, one or more regions comprising an attachment embossing, and that the region not comprising an attachment embossing is at least about 50%, preferably at least about 80% and in some preferred embodiments as much as about 99%, of the surface area of the tissue. Most commonly the regions comprising an attachment embossing lie close to the edge of the tissue (for example along two or four edges); and a regions comprising an attachment embossing may also be used for decorative purposes (for example to create a pattern or to spell out a logo or brand name). The region not comprising an attachment embossing is the continuous region between and/or around the region comprising an attachment embossing. Attachment embossing is preferably done by pin-to-pin embossing and with 10 to 40 embossing elements per square centimeter having a height from about 0.01 mm to about 1 mm, preferably about 0.05 mm to about 0.2 mm. The percentage of attachment embossed areas to unembossed or fine embossed areas of the total surface area of a paper tissue product is preferably about 0.01% to about 5%. Attachment embossing involves as substantive densification of the paper tissue products as to achieve the attachment. Therefore the space between and embossing element and its counterpart, e.g. two pins where pin-to-pin embossing is employed, is less that the caliper of the paper tissue to be embossed, typically about 5% to about 50%, preferably about 10% to about 20% of the caliper of the paper tissue to be embossed, which leads to embossing pressures of about 10,000 to about 50,000 N/square centimeter.

The method of the present invention may further comprise a step of providing sheets suitable for paper tissue products, such as paper handkerchiefs. Such step typically comprises cutting of portions of the paper tissue web.

If desired, the paper tissue products according to the present invention may be provided with functional or aesthetic indicia. The indicia may be applied to either or both of the surfaces of the paper tissue products. The indicia may cover all or part of the paper tissue products and be applied in a continuous or discontinuous pattern.

The indicia may be applied to the paper tissue products by any means well known in the art, such as spraying, extruding, and preferably printing. Examples of printing methods include gravure or flexographic printing. If printing is selected as the means for applying the indicia, the printing apparatus may be constructed according to the teachings of commonly assigned U.S. Pat. No. 5,213,037 issued May 25, 1993 to Leopardi, II. If desired, the apparatus may have reservoir baffles, as disclosed in commonly assigned U.S. Pat. No. 5,255,603 issued Oct. 26, 1993 Sonneville et al. If desired, the indicia may be requested with perforations or drop off cuts as disclosed in commonly assigned U.S. Pat. No. 5,802,974 issued Sep. 8, 1998 to McNeil. The disclosures of the aforementioned patents are incorporated herein by reference.

Test Methods

Lotion Transfer Test

The test is performed in a conditioned room where the temperature is 22° C.+2.2° C. and the relative humidity is 50%+10%.

a) Objective

Objective of the test is to measure the lotion amount transferred to a glass surface under stationary conditions and/or under rubbing conditions.

b) Apparatus/Materials List

1. Glass plate measuring 20 cm×30 cm or known weight.

2. Metal weight with a squared tissue paper contacting surface of 2 cm×3 cm.

3. 5 mm thick hard rubber plate equal to dimensions of the glass plate.

4. Analytical balance (0.0001 g resolution).

c) Sample Preparation

Use a tissue paper sample measuring roughly 20 cm×20 cm. Evenly apply lotion by spraying the sample, choosing the amount of lotion to achieve an application of 10 g lotion per square meter.

d)

i) Stationary Test

Place the lotioned sample over the glass plate. Cover it with the hard rubber plate and put the metal weight onto it. The metal weight should apply 9 kPa on the paper/glass surface. Wait for 15 seconds and remove carefully the metal weight, hard rubber plate and paper. Now, measure the weight of the glass plate. By subtraction of the two weights (lotioned glass—non-lotioned glass) you obtain the amount of lotion transferred.

ii) Dynamic Test (Rubtest)

Take the lotioned sample and wrap it around the paper contacting surface of the metal weight.

The metal weight should apply 9 kPa on the paper surface (adjust weight if needed).

Place the metal bar/paper on a glass surface with known weight and having 100×30 mm in surface dimensions.

Rub 10 times back and forth over a length of 15 cm of the glass surface with 50 mm/sec. Then remove the metal bar with the paper attached and measure the weight difference of the glass plate.

f) Results

Repeat the test 10 times and take the arithmetic average as the result. Report the average amount of lotion transferred in % of the amount of lotion comprised by the paper tissue product.

Caliper is measured according to the following procedure: The tissue paper is preconditioned at 21° to 24° C. and 48 to 52 percent relative humidity for two hours prior to the caliper measurement. If the caliper of toilet tissue is being measured, 15 to 20 sheets are first removed and discarded. If the caliper of facial tissue is being measured, the sample is taken from near the center of the package. The sample is selected and then conditioned for an additional 15 minutes.

Caliper of the multi-ply paper tissue, as used herein, is the thickness of the paper when subjected to a compressive load of 14.7 g/cm$^2$. Preferably, caliper is measured using a low load Thwing-Albert micrometer, Model 89-11, available from the Thwing-Albert Instrument Company of Philadelphia, Pa. The caliper per ply is the total caliper of the multi-ply paper tissue divided by the number of plies comprised. For a single ply tissue caliper per ply and caliper are identical. Decorated regions, perforations, edge effects, etc., of the tissue should be avoided if possible.

The wet burst strength is measured using an electronic burst tester and the following test conditions. The burst tester is a Thwing-Albert Burst Tester Cat. No. 177 equipped with a 2000 g load cell. The burst tester is supplied by Thwing-Albert Instrument Company, Philadelphia, Pa. 19154, USA.

Take eight paper tissues and stack them in pairs of two. Using scissors, cut the samples so that they are approximately 228 mm in the machine direction and approximately 114 mm in the cross-machine direction, each two finished product units thick.

First age the samples for one to two hours by attaching the sample stack together with a small paper clip and "fan" the other end of the sample stack to separate the sheets, this allows circulation of air between them. Suspend each sample stack by a clamp in a 107° C. (±3° C.) forced draft oven for 5 minutes (±10 seconds). After the heating period, remove the sample stack from the oven and cool for a minimum of three minutes before testing.

Take one sample strip, holding the sample by the narrow cross direction edges, dipping the center of the sample into a pan filled with about 25 mm of distilled water. Leave the sample in the water four (4.0±0.5) seconds. Remove and drain for three (3.0±0.5) seconds holding the sample so the water runs off in the cross direction. Proceed with the test immediately after the drain step. Place the wet sample on the lower ring of the sample holding device with the outer surface of the product facing up, so that the wet part of the sample completely covers the open surface of the sample holding ring. If wrinkles are present, discard the sample and repeat with a new sample. After the sample is properly in place on the lower ring, turn the switch that lowers the upper ring. The sample to be tested is now securely gripped in the sample holding unit. Start the burst test immediately at this point by pressing the start button. The plunger will begin to rise. At the point when the sample tears or ruptures, report the maximum reading. The plunger will automatically reverse and return to its original starting position. Repeat this procedure on three more samples for a total of four tests, i.e., 4 replicates. Report the results, as an average of the four replicates, to the nearest gram.

The dry tensile strength is measured according to the following procedure: The test is performed on one inch by five inch (about 2.5 cm×12.7 cm) strips of paper (including handsheets as described below, as well as other paper sheets) in a conditioned room where the temperature is 28° C.±2.2° C. and the relative humidity is 50%±10%. An electronic tensile tester (Model 1122, Instron Corp., Canton, Mass.) is used and operated at a crosshead speed of 2.0 inches per minute (about 5.1 cm per min.) and a gauge length of 4.0 inches (about 10.2 cm). Reference to a machine direction means that the sample being tested is prepared such that the 5" dimension corresponds to that direction. Thus, for a machine direction (MD) dry tensile strength, the strips are cut such that the 5" dimension is parallel to the machine direction of manufacture of the paper product. For a cross machine direction (CD) dry tensile strength, the strips are cut such that the 5" dimension is parallel to the cross-machine direction of manufacture of the paper product. Machine-direction and cross-machine directions of manufacture are well known terms in the art of paper-making. The MD and CD tensile strengths are determined using the above equipment and calculations in the conventional manner taking the arithmetic average of at least six strips tested for each directional strength. The dry tensile strength, as used herein, is the arithmetic average of the average MD and the average CD tensile strengths.

For the physiological surface smoothness measurement, which reports the PSS parameter, a sample of the paper tissue is selected which avoids wrinkles, tears, perforations, or gross deviations from macroscopic monoplanarity. The sample is conditioned at 22 to 24° C. and 48 to 52% relative humidity for at least two hours prior to testing. The sample is placed on a motorized table and magnetically secured in place. Either face of the sample may be selected for the measurement, provided all traces are taken from the same face.

Physiological surface smoothness is obtained by scanning the paper tissue sample in any direction with a profilometer to obtain the Z-direction displacement as a function of distance. The Z-direction displacement is converted to an amplitude versus frequency spectrum by a Fourier Transform. The spectrum is then adjusted for human tactile response using a series of filters. The peak heights of the filtered amplitude frequency curve are summed from 0 to 10 cycles per millimeter to give the result.

The paper tissue sample is approximately 100 millimeters× 100 millimeters in size and mounted on a motorized table. While any suitable table will suffice, a table with surface tester model KES-FB-4NKES-SE, available from Kato Tech Company Limited of Kyoto, Japan, or a CP3-22-01 DCI Mini Precision table using a NuStep 2C NuLogic Two Axis Stepper Motor Controller in the closed loop control mode have been found suitable. The table has a constant drive motor which travels at the rate of 1 millimeter per second. The sample is scanned 30 millimeters in the forward direction transversely indexed one millimeter, then reversed. Data are collected from the center 26 millimeters of the scan in both the forward and reverse directions. The first and last 2 millimeters of each scan are ignored and not used in the calculations.

The profilometer has a probe with a tip radius of 2.54 microns and an applied force of 0.20 grams. The gauge range is calibrated for a total Z-direction displacement of 3.5 millimeters. Over the scan distance of the sample, the profilometer senses the Z-direction displacement of the stylus in millimeters. The output voltage from the gauge controller is digitized at a rate of at least 20 points per second. Over the entire 26 millimeter scan range, 512 pairs of time surface height data points are obtained for both the forward and reverse directions of a scan. The profilometer is mounted above the sample table such that the surface topography can be measured. A suitable profilometer is a EMD 4320 WI Vertical Displacement Transducer, having an EPT 010409 stylus tip, and an EAS 2351 Analog Amplifier. This equipment is obtainable from Federal Products of Providence, R.I.

The digitized data pairs are imported into a standard statistical analysis package for further analysis. Suitable software analysis packages included SAS of Cary, N.C., and preferably LabVIEW Instrument Control Software 3.1 available from National Instruments of Austin, Tex. When using the LabVIEW software, raw data pairs linking surface height and time from the individual scans are centered about the mean using the Mean.vi analysis tool in the LabVIEW software. The 512 data points from each of the 16 traces are converted to 16 amplitude spectra using the Amplitude and Phase Spectrum.vi tool. Each spectrum is then smoothed using the method described by the PROC Spectra Method of the SAS software. LabVIEW smoothing filter values of 0.000246, 0.000485, 0.00756, 0.062997, 0.00756, 0.000485, 0.000246 are utilized. The output from this tool is taken as the Amp Spectrum Mag (vrms).

The amplitude data are then adjusted for human tactile response using a series of frequency filters designed from Verrillo's data on vibrotactile thresholds as a function of vibration frequency as set forth in the Journal of Acoustical Society of America, in the article entitled "Effect Of Contactor Area On The Vibrotactile Threshold", Vol. 35, 1962 (1963). The aforementioned data are reported in a time domain as cycles per second and converted to the spatial domain in cycles per millimeter. The conversion factor and filter values are found in the procedure set forth in the 1991 International Paper Physics Conference, TAPPI Book 1, more particularly the article entitled "Methods For The Measurement Of The Mechanical Properties Of Paper tissue" by Ampulski, et al., and found at page 19, utilizing the specific procedure set forth at page 22 entitled "Physiological Surface Smoothness". The response from the filters are set at 0 below the minimum threshold and above the maximum response frequencies and varies from 0 to 1 therebetween as described by the aforementioned Ampulski et al. article.

The physiologically adjusted frequency amplitude data are obtained by multiplying the amplitude spectra described above by the appropriate filter value at each frequency. A typical amplitude spectrum and filtered amplitude spectrum are illustrated in FIG. 5 of the aforementioned Ampulski et al. article. The Verrillo-adjusted frequency amplitude curve is summed point by point between 0 and 10 cycles per millimeter. This summation is considered to be the physiological surface smoothness. The eight forward and eight reverse physiological surface smoothness values thus obtained are then averaged and reported in microns.

Physiological surface smoothness measurements using the SAS software is described in commonly assigned U.S. Pat Nos. 4,959,125, issued Sept. 25, 1990 to Spendel; 5,059,282, issued Oct. 22, 1991 to Ampulski et al.; 5,855,738, issued Jan. 5, 1999 to Weisman et al., and 5,980,691, issued Nov. 9, 1999 to Weisman et al.

Either face of the tissue may be selected for the smoothness measurement, provided all traces are taken from the same face. If either face of the tissue meets any of the smoothness criteria set forth herein, the entire sample of the tissue is deemed to fall within that criterion. Preferably both faces of the tissue meet the above criteria.

All documents cited are, in relevant part, incorporated herein by reference; the citation of any document is not to be construed as an admission that it is prior art with respect to the present invention. Further, while particular embodiments and/or individual features of the present invention have been illustrated and described, it would be obvious to those skilled in the art that various other changes and modifications can be made without departing from the spirit and scope of the invention. It should be apparent that all combinations of such embodiments and features are possible and can result in preferred executions of the invention. Therefore, the appended claims are intended to cover all such changes and modifications that are within the scope of this invention.

The invention claimed is:

1. A method for making a multi-ply tissue paper product from at least two tissue paper webs, said method comprising the steps of:

passing said at least two tissue paper webs through an embossing nip formed between a first and a second embossing roll, wherein at least one of said embossing rolls comprises at least 30 embossing elements per square centimeter and whereby said embossing nip fixably attaches at least a first portion of a first tissue paper web of said at least two tissue paper webs to at least a first portion of a second tissue paper web of said at least two tissue paper webs;

calendering both of said at least two tissue paper webs;

wherein said embossing and calendering steps are adapted to increase a caliper of said multi-ply tissue paper product by at least about 10 percent compared to the caliper of an unembossed and uncalendared paper web; and, applying a transferable lotion to at least a first side of said multi-ply of said tissue paper product such that said tissue paper product is adapted to transfer a first quantity of said transferable lotion upon stationary contact with a glass surface and transferring a second quantity of said transferable lotion upon dynamic contact with a glass surface, wherein said second quantity is at least 5 times greater than said first quantity.

2. The method according to claim 1, wherein least one of said embossing rolls comprises at least 50 embossing elements per square centimeter.

3. The method of claim 1, wherein said embossing elements have a height of less than 0.5 mm.

4. The method of claim 1, wherein said first embossing roll has a web contacting surface comprising a rubber material and said second embossing roll has a web contacting surface comprising a hard material.

5. The method of claim 1, wherein in that said step of applying a lotion to at least portions of said tissue paper web is carried out after said step of passing said tissue paper web through an embossing nip.

6. The method of claim 1 further comprising a step of cutting sheets as to provide paper tissue products.

7. A tissue paper product made according to claim 1.

* * * * *